US007866092B2

(12) United States Patent
Weinberg

(10) Patent No.: US 7,866,092 B2
(45) Date of Patent: Jan. 11, 2011

(54) DEVICE FOR THE RENOVATION OF FLAT ROOFS

(75) Inventor: Michael Weinberg, Rheinfelden (DE)

(73) Assignee: Terra Consulting GmbH, Polheim (DE)

( * ) Notice: Subject to any disclaimer, the term of this patent is extended or adjusted under 35 U.S.C. 154(b) by 0 days.

(21) Appl. No.: 12/026,443

(22) Filed: Feb. 5, 2008

(65) Prior Publication Data

US 2008/0196320 A1 Aug. 21, 2008

(30) Foreign Application Priority Data

Feb. 19, 2007 (EP) ..... 07003415

(51) Int. Cl.
*E04B 7/00* (2006.01)
*E04B 7/02* (2006.01)

(52) U.S. Cl. ..... 52/23; 52/90.2

(58) Field of Classification Search ..... 52/4, 52/23, 63, 83, 90.2, 222, 745.06
See application file for complete search history.

(56) References Cited

U.S. PATENT DOCUMENTS

| | | | | |
|---|---|---|---|---|
| 2,548,758 | A * | 4/1951 | Agle | 52/641 |
| 3,869,836 | A * | 3/1975 | Allen | 52/23 |
| 3,982,361 | A | 9/1976 | Deutsch et al. | |
| 4,890,427 | A * | 1/1990 | Rayburn | 52/90.2 |
| 5,247,925 | A * | 9/1993 | Yamasaki et al. | 601/49 |
| 5,347,768 | A * | 9/1994 | Pineda | 52/23 |
| 5,522,184 | A * | 6/1996 | Oviedo-Reyes | 52/23 |
| 5,579,794 | A * | 12/1996 | Sporta | 135/88.01 |
| 5,596,843 | A * | 1/1997 | Watson | 52/71 |
| 5,660,004 | A * | 8/1997 | Blackmon et al. | 52/90.2 |
| 5,778,999 | A * | 7/1998 | Nealeigh | 182/82 |
| 5,791,090 | A * | 8/1998 | Gitlin et al. | 52/4 |
| 5,799,680 | A * | 9/1998 | Dorflinger | 135/96 |
| 6,085,468 | A * | 7/2000 | Quiring et al. | 52/63 |
| 6,923,498 | B1 * | 8/2005 | Mecham | 296/210 |
| 2005/0126106 | A1 * | 6/2005 | Murphy et al. | 52/652.1 |
| 2005/0166468 | A1 * | 8/2005 | Pierce | 52/23 |

FOREIGN PATENT DOCUMENTS

| | | |
|---|---|---|
| DE | 1759540 | 6/1971 |
| DE | 19610450 | 9/1997 |
| DE | 10200896 | 10/2002 |
| FR | 2680823 | 3/1993 |
| GB | 2228024 | 8/1990 |
| GB | 2326437 | 12/1998 |
| GB | 2336390 | 10/1999 |

OTHER PUBLICATIONS

European Search Report, EPA Form 1507N from European Patent Office, Aug. 29, 2007.

* cited by examiner

*Primary Examiner*—Brian E Glessner
*Assistant Examiner*—Benjamin Pevarski
(74) *Attorney, Agent, or Firm*—Michael Best & Friedrich LLP

(57) ABSTRACT

The present invention relates to a device for the renovation of a flat roof of a building, while at least partially maintaining the old roof structure, with at least three attachment devices for attaching a second roof disposed over the flat roof being renovated, the second roof being made of a flexible, tensible surface material which is disposed by means of the at least three attachment devices over the flat roof such that it covers the area of the flat roof.

17 Claims, 4 Drawing Sheets

DEVICE FOR THE RENOVATION OF FLAT ROOFS

FIELD OF THE INVENTION

The present invention relates to a device for the renovation of a flat roof, while at least partially maintaining the old roof structure, with at least three attachment devices for attaching a second roof disposed over the flat roof being renovated.

BACKGROUND OF THE INVENTION

These types of devices are generally known and in particular described in publication DE 10 200 896 A1. Publication DE 10 200 896 A1 discloses a method for renovating saturated flat roofs, while maintaining their substance, with which a heat insulation plate is either laid directly over the old roof structure or the old covering layer of the old roof structure is removed before it is laid. On their lower side the heat insulation plates have a water-absorbent or -retaining layer which also releases the water again, by means of which it is possible for the damaged flat roof to be dried. In this way, costs associated with a total renovation such as the costs for rebuilding and material, costs for disposing of the old roof material and the heat insulation layers and further building materials, such as for example polyurethane hard foams and extruded polystyrene, are reduced or totally avoided. However, the heat insulation plate disclosed in this document is also very expensive and complex to produce.

Document DE 196 10 450 A1 proposes a method for renovating a flat roof of a reinforced concrete prefabricated garage with which purlins are disposed over the flat roof which have purlin feet by means of which the purlins are attached to the flat roof in need of renovation. A sheet steel second roof is applied over the purlins, and this covers the flat roof with an overhang. Due to the extremely large dimensions with large buildings, the transportation of these second roofs, e.g. to building sites, is very complex and expensive, and so not advantageous. Due to their bulkiness and weight, the fitting of such large individual components is also very difficult.

With flat roofs in several parts designed in this way, there is often the problem of leaks at the connecting points. With the conventional measures, e.g. sealing with bitumen or similar, a repair to the leaky parts is complex and often not very successful.

SUMMARY OF THE INVENTION

Therefore, the object which forms the basis of the invention is to provide flat roofs in need of renovation in a simple way with a second roof which is easy to fit and as inexpensive as possible to produce.

This object is achieved according to the invention in that the second roof is made of a flexible, tensible surface material which is disposed by means of the at least three attachment means over the flat roof such that it covers the area of the flat roof.

By using a flexible, tensible surface material it is possible to roll or fold up the second roof easily for transportation or also after dismantling the roof. This tensible surface material can be provided in one or more parts and, for example, comprise two or more individual tensible surface materials and, for example, be made up of two or more individual tensible surface elements. In order to guarantee impermeability with composite surface materials it is possible to provide simple attachment rails between the individual strips of material. Watertight attachment is very easy to achieve due to the flexibility of the material and due to the simple insertion of sealing elements in the attachment rails, and makes handling particularly easy. The flexible, tensible surface material can be, for example, a textile or a synthetic cover.

One embodiment of the present invention which is particularly space saving makes provision such that the attachment device for bearing loads can be fixed onto the building, in particular by means of fastening struts, and in particular onto the façade and/or the eaves of the building. In this case no additional installation space is required for fitting and fixing the second roof in a horizontal direction because there is only one structure in the vertical direction.

In one exemplary embodiment of the present invention the attachment devices are height-adjustable and/or pivotable in design. This enables particularly flexible applicability. Also, on the one hand height differences in the existing flat roof can be leveled out, and on the other hand it is possible to set an incline defined simply by adjusting the respective attachment devices on the second roof.

In a further exemplary embodiment the attachment devices for bearing loads are embedded into the foundations of the building or fixed onto a region of the building which has sufficient stability such as e.g. an adjacent structure or one that is either already in existence or can be erected for this purpose next to the flat roof structure. In this way the load brought about by the second roof is diverted in a simple manner into the foundations of the building, and so any further loading of the roof truss, which may already be subject to loading, of the flat roof is avoided.

Alternatively, the attachment devices can also be free-standing in design, whereby, by means of further support elements, the point of load application for the load of the second roof is almost totally supported by the attachment device and discharged into the ground surrounding the flat roof structure.

In a further exemplary embodiment of the present invention the device for renovating a flat roof has a support device, in particular in the form of staging or in the form of an arched tube lattice in order to secure and support the roof structures of the old flat roof by means of holding elements, and so e.g. to bring about a drying effect of the old roof structure, and so stabilisation of the roof structure. It is also possible by means of the holding elements to fit further stabilising elements to the joists of the old roof structure and to underlay the latter for example with a stable material such as a further wooden beam or a joist or similar made of reinforced concrete or steel posts.

The holding elements can be in the form of anchoring and/or cable straps and/or clamps and/or all further conceivable possible attachment devices known from the prior art, and can be height-adjustable, in particular by means of screw connectors.

The support device itself can be attached by screwing and/or welding either to the edge region of the building being renovated or to the attachment devices and/or the support bolts of the latter.

With regard to further advantageous embodiments and further developments of the invention, reference is made to the sub-claims and to the following description of an exemplary embodiment by means of the attached drawings. These show as follows:

DETAILED DESCRIPTION

Figure 1:
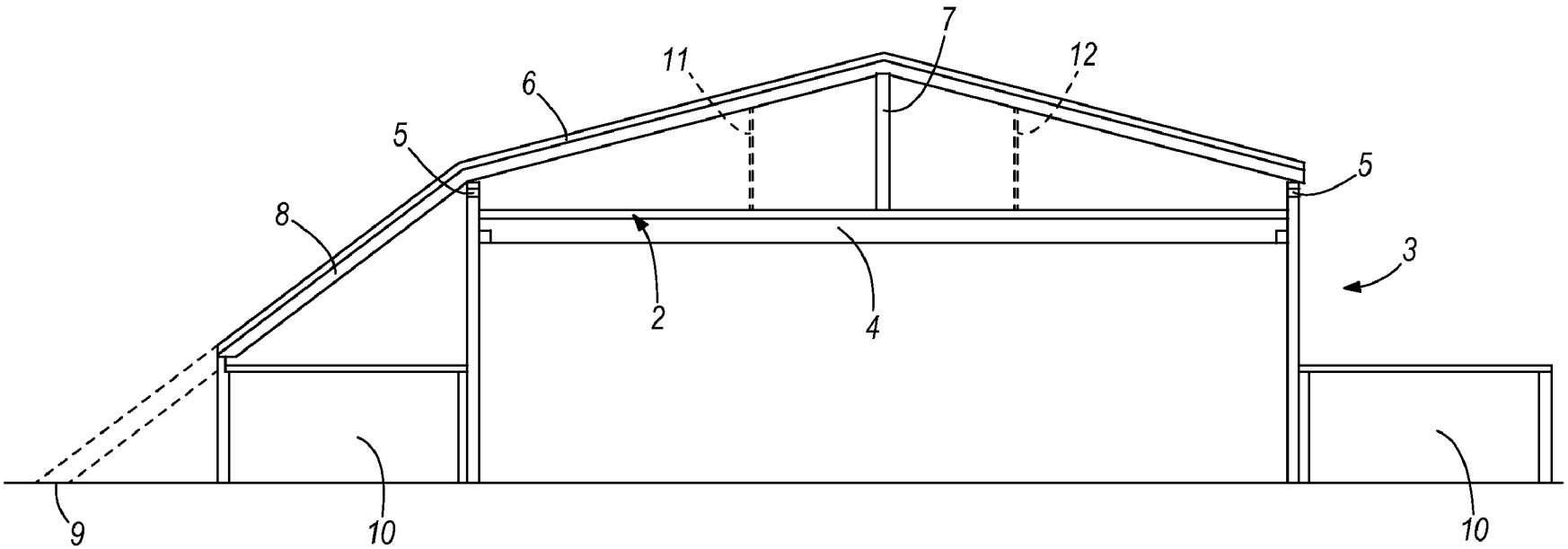
FIG. 1 is a diagrammatic illustration of a cross-section through a building with a flat roof on which is disposed a second roof according to the invention.

FIG. 1 shows a device 1 for the renovation of a flat roof 2 of a building 3. The device 1 is placed on the building 3, while maintaining the old roof structure 4, and has four attachment devices 5 and a tensible surface material 6 which is stretched over the old roof structure 4 and so forms a second roof stretched over the flat roof 2 being renovated. The surface material 6 here is made of a textile which is disposed by means of the four attachment devices 5 over the flat roof 2 such that it totally covers the area of the flat roof 2. In a further exemplary embodiment the flexible, tensible surface material 6 is made of a synthetic cover. Of course it is also possible to design the surface material 6 and the attachment devices 5 such that when in the stretched state the surface material projects over the flat roof 2.

In order to achieve a slant or a defined incline of the second roof 6, and thus to guarantee easier discharge of rain or dirt, in this exemplary embodiment further attachment devices 7 are disposed centrally on the flat roof 2 which are of greater height than the other attachment devices 5 disposed in the corner regions of the area of the flat roof 2. The attachment devices 5 and 7 are identical in design. Due to their height-adjustability it is possible to use the same parts for the flat roof renovation in order to reduce the variety of parts, and to height-adjust and adapt the latter only in accordance with the intended area of application.

In order to be also able to fit the attachment devices 5 at points which are difficult to access, in this exemplary embodiment the attachment devices 5 and 7 are pivotable in design so that fitting at the site is also possible in a position which does not correspond to the end position for fixing the second roof, but can be brought into this position simply by turning the attachment devices 5. In the right-hand part of FIG. 1 a device 1 according to the invention is shown, the attachment devices 5 of which are fixed in order to bear loads on the building 3, in particular here on the façade of the building 3. An equivalent solution is offered when the attachment devices 5 are fixed in or on the eaves of the building 3.

With ramshackle buildings which can not be expected to tolerate an additional load, it is possible and also wise to fix the attachment devices 5 for bearing loads by means of attachment struts 8, for example in the foundations 9 of the building 3 or on less ramshackle adjacent structures 10. This type of embodiment of the attachment devices 5 is shown in the left-hand part of FIG. 1. It can be seen that the attachment struts 8 can be attached either to the adjacent structure 10 or in the ground region outside of the building complex 3. The adjacent structure 10 can be an already existing building, but it can also be newly built as an extra in order to support the attachment struts 8 and/or attachment devices 5.

In the case of fixing the attachment struts 8 in the ground outside of the building complex 3 the assembly of the attachment device 5, 7 is designed to be free-standing so that the load of the second roof 6 is almost totally and exclusively supported by the attachment devices 5, 7 themselves.

Figure 2:
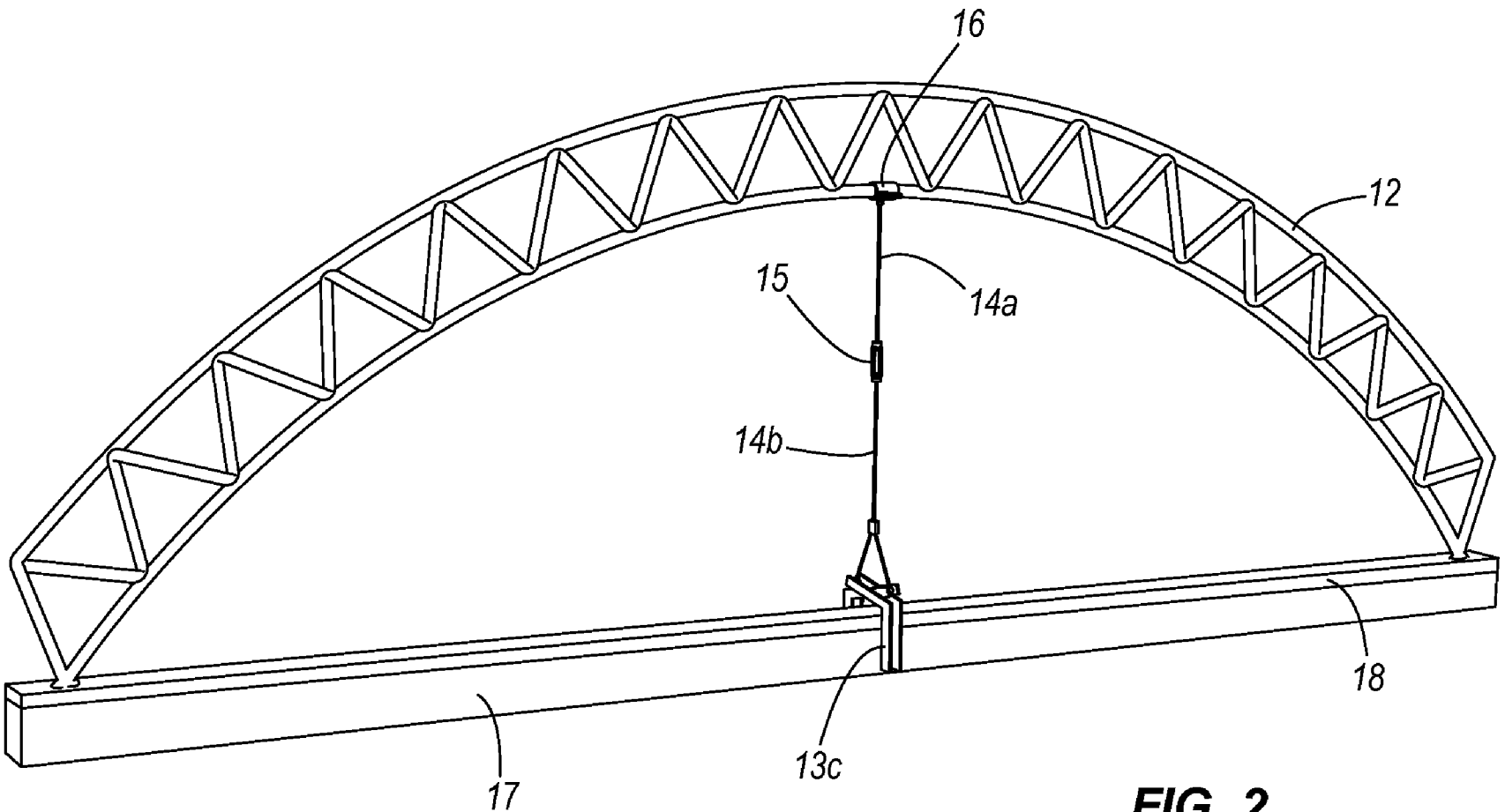
FIG. 2 illustrates a support device according to the invention in the form of an arched tube lattice.
Figure 3:
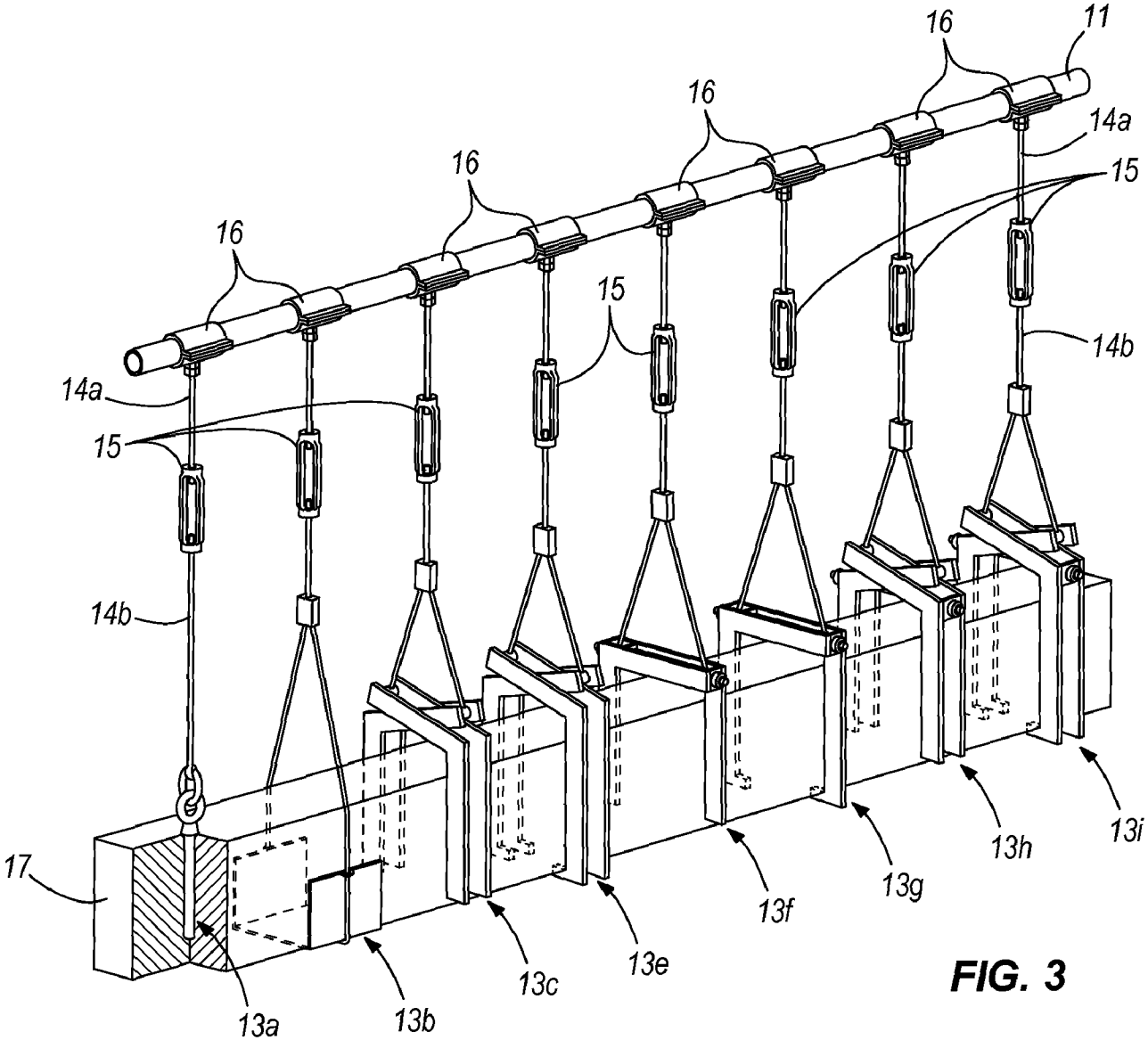
FIG. 3 illustrates a support device in the form of a support joist on which different embodiment of holding devices for supporting the joists of the old roof structure are shown.
Figure 4:
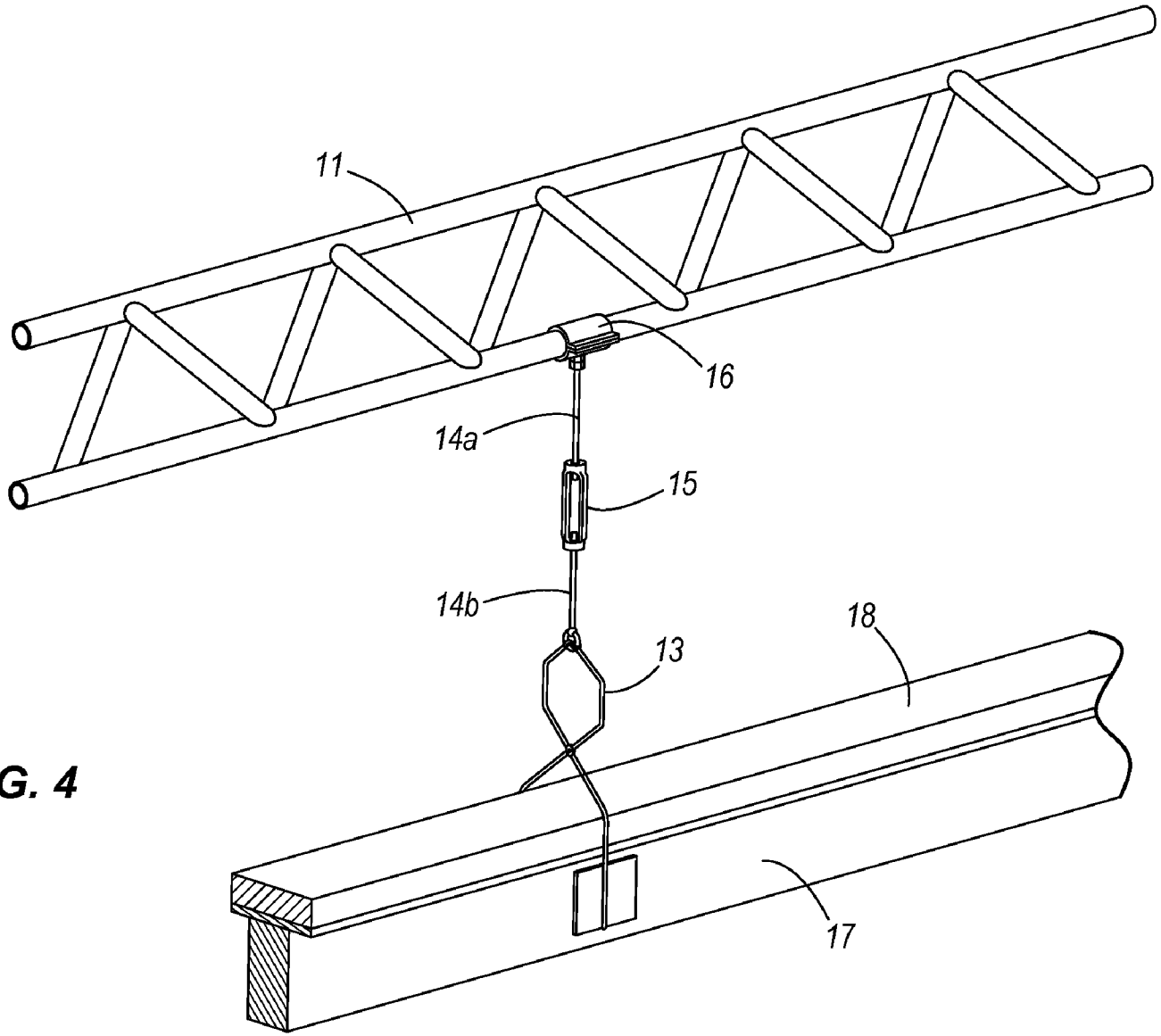
FIG. 4 is a diagrammatic illustration of a holding device according to FIG. 3.

In order to be able to maintain the old roof structure 4, and in particular to prevent a possibly threatened collapse of the old roof structure 4 of the flat roof 2, in one exemplary embodiment of the present invention a support device in the form of staging 11, as shown in FIG. 3, or of an arched tube lattice 12, as shown in FIG. 2, is provided. Holding elements 13*a*-13*e* are suspended from the staging 11 or the arched tube lattice 12 which by means of attachment types known from the prior art secure and support the roof structure 4, and in particular the joist structure of the latter. Possible embodiments of the attachment are realized by means of anchoring and cable straps and by means of clamps. In order to attach the joists of the old roof structure 4 to the staging 11, the holding element 13*a*-13*e* according to FIG. 4 has two threaded rods 14*a*, 14 *b* the total length of which can be adjusted using a screw connector 15. At its free end the threaded rod 14*a* is welded to the staging 11 by means of a collar 16. Of course, screwing is also conceivable and an alternative. The threaded rod 14*b* is provided at its opposite free end with a scissor clamp which engages around the wooden beams 17 of the roof structure 4 which in this exemplary embodiment is further provided with an insulating layer 18.

The staging 11, 12 can either be attached, and in particular be screwed or welded, to the building 3, for example in the region of the outer walls or also to the attachment devices 5, 7 or attachment struts 8.

Various features and advantages of the invention are set forth in the following claims.

What is claimed is:

1. A device for the renovation of a flat roof of a building, while at least partially maintaining the old roof structure, the device comprising:

a first attachment device configured to connect to a portion of a first side of the building other than the flat roof;

a second attachment device configured to connect to a portion of an opposite second side of the building other than the flat roof;

a second roof positioned over the flat roof being renovated and coupled to the first and second attachment devices, wherein the second roof comprises a flexible, tensible material, and wherein the second roof entirely covers the flat roof;

at least one additional attachment device positioned between and connected to the flat roof and the second roof; and a support device supporting the flat roof, the support device including a support member positioned over the flat roof and extending from the first side of the building to the opposite second side of the building, and at least one holding element extending from the support member, the at least one holding element including a first end connected to the support member and a second end secured to the flat roof.

2. The device for the renovation of a flat roof according to claim 1, wherein the flexible, tensible material is a textile or a synthetic cover.

3. The device for the renovation of a flat roof according to claim 1, wherein at least one of the first and second attachment devices is connected to one of a façade and an eave of the building.

4. The device for the renovation of a flat roof according to claim 3, wherein at least one of the first and second attachment devices is configured to be one of height-adjustable and pivotable.

5. The device for the renovation of a flat roof according to claim 1, wherein at least one of the first and second attachment devices is fixed by means of attachment struts in the foundations of the building.

6. The device for the renovation of a flat roof according to claim 1, wherein at least one of the attachment devices is configured to substantially support the second roof.

7. The device for the renovation of a flat roof according to claim 1, wherein the support member is in the form of an arched tube lattice.

8. The device for the renovation of a flat roof according to claim 1, wherein the holding element includes one of an anchor, a cable strap, and a clamp.

9. The device for the renovation of a flat roof according to claim 8, wherein the holding element is height-adjustable.

10. The device for the renovation of a flat roof according to claim 1, wherein the holding element is connected to the support member by means of screwing and/or welding.

11. The device for the renovation of a flat roof according to claim 1, wherein the holding element is connected to a joist of the flat roof.

12. The device for the renovation of a flat roof according to claim 1, wherein a plurality of holding elements are suspended from the support member.

13. The device for the renovation of a flat roof according to claim 1, wherein the second roof is configured to replace the flat roof.

14. The device for the renovation of a flat roof according to claim 1, wherein the additional attachment device positioned between the flat roof and the second roof is substantially centrally located with respect to the flat roof.

15. The device for the renovation of a flat roof according to claim 1, wherein the second roof is configured to replace the flat roof.

16. The device for the renovation of a flat roof according to claim 1, wherein at least one of the first and second attachment devices each include a first end and a second end, and wherein the additional attachment device includes a first end and a second end, and wherein the first end of the additional attachment device is oriented at a higher elevation than both the first end and the second end of at least one of the first and second attachment devices.

17. A device for the renovation of a flat roof of a building, while at least partially maintaining the old roof structure, the device comprising:

at least three attachment devices configured to connect to a portion of the building other than the flat roof;

a second roof positioned over the flat roof being renovated and coupled to the at least three attachment devices, wherein the second roof is made of a flexible, tensible material, and wherein the second roof entirely covers the flat roof; and a support device supporting the flat roof, the support device including a support member positioned over the flat roof and extending from a first side of the building to an opposite second side of the building, and at least one holding element extending from the support member, the at least one holding element including a first end connected to the support member and a second end secured to the flat roof.

* * * * *